US005410960A

United States Patent [19]

Adsett

[11] Patent Number: 5,410,960

[45] Date of Patent: May 2, 1995

[54] INK VIBRATOR

[75] Inventor: Willie Adsett, Marlboro, N.Y.

[73] Assignee: Joseph B. Taphorn, Poughkeepsie, N.Y. ; a part interest

[21] Appl. No.: 571,164

[22] Filed: Aug. 20, 1990

[51] Int. Cl.[6] ..... B41J 31/06

[52] U.S. Cl. ..... 101/363

[58] Field of Search ..... 101/364, 363, 350, 207–210; 366/116, 114, 117, 118, 120, 121, 122, 123, 242, 243, 245, 241, 276, 277, 278, 333, 342, 343, 605, 600, 248, 249, 250

[56] References Cited

U.S. PATENT DOCUMENTS

| | | | |
|---|---|---|---|
| 1,615,769 | 1/1927 | Ortleb et al. | 101/364 |
| 1,757,808 | 5/1930 | Marquardt | 101/DIG. 34 |
| 1,778,600 | 10/1930 | Jones | 101/364 |
| 2,447,868 | 8/1948 | Ortleb | 101/364 |
| 3,113,225 | 12/1963 | Kleesattel et al. | 101/364 X |
| 3,591,862 | 7/1971 | Winston | 366/118 X |
| 3,746,310 | 7/1973 | Fransson et al. | 366/120 |
| 3,945,618 | 3/1976 | Shoh | 366/118 |
| 3,955,802 | 5/1976 | de Bruyne | 366/243 X |
| 3,995,581 | 12/1976 | Smejda | 101/211 |

*Primary Examiner*—J. Reed Fisher
*Attorney, Agent, or Firm*—Joseph B. Taphorn

[57] ABSTRACT

Stiff ink in a ink fountain of a high-speed printing press or the like is maintained at the viscosity necessary to wet a printing roller by vibrating a rod placed in the ink in the fountain. The rod is mounted on arms pinned to trunnions, one of which trunnions is fixed to an air turbine oscillator. The oscillator when activated, transmits vibrations to a trunnion to which it is fixed. The vibrations pass on to the associated arm and on to the rod to agitate the ink. The trunnions are mounted on vibration isolators on the cheeks of the ink fountain. The rod being mounted via the arms on the trunnions, is swingable in and out of the fountain for cleaning purposes as on ink changes.

8 Claims, 3 Drawing Sheets

INK VIBRATOR

BACKGROUND OF THE INVENTION

1. Field of the Invention

This invention relates to ink agitators used to prevent the setting of ink in printing press fountains, and more particularly to an ink agitator for very stiff inks such as those dried by ultraviolet light. Unfortunately, such inks also setup very readily; ambient light, such as that from florescent lamps, speeds up the setting process.

2. Prior Art Information

Printing presses today employ rotatable cones whose pointed ends extend into the ink fountains. A cone is mounted on a mechanical arm which moves a distance across a fountain sufficient for the cone to stir the ink therein. However, the mechanism is ineffective to keep the quicksetting stiff inks at a pliable viscosity.

Ink agitator patents include U.S. Pat. Nos. 584,247 (Templin); 1,615,769 (Ortleb et al); 1,077,882 (Holz); 1,401,218 (Weldon); 1,778,600 (Jones); 1,835,325 (Ortleb); and 2,447,868 (Ortleb). Templin moves agitator blades D back and forth across an ink fountain. Holz rotates stirrers 12 or 31 down, through, and up the ink in a fountain to move the ink against an ink roller. Weldon moves a stirrer having curved deflection plates 27 back and forth across in ink fountain and in front on a inking roller. Ortleb et al applies short jerky motions to a plurality of fingers 41 travelling back and forth across the spaces between them in an ink fountain. Jones traverses a carriage having a) a scraping blade 35 which moves back and forth through an ink fountain to create a wave which travels from one end of the ink fountain to the other and b) depending wave-braking rods 40 to impart spiral motion to ink portions. Ortleb (U.S. Pat. No. 1,835,325) imparts short jerky strokes to a plurality of stirrers moved relatively slowly back and forth across the spaces between them in an ink fountain. Ortleb (U.S. Pat. No. 2,447,868) moves continuously a plurality of agitating blades 12 back and forth across an ink fountain D.

Modern printing presses use very stiff inks such as those dried by ultraviolet light. Such stiff inks also setup or harden very rapidly, particularly in the presence of florescent ambient light. The identified ink agitators are unsuitable for handling such stiff inks.

Vibrating a printing or dyeing compound to improve penetration of a permeable flat shaped material is taught by Zimmer et al. U.S. Pat. No. 3,902,414. However Zimmer et al do not contemplate using vibration to keep very stiff ink from setting, let alone any inks.

SUMMARY OF THE INVENTION

Accordingly, it is an object of the invention to provide an apparatus and method for preventing the setting of very stiff inks such as those dried by ultra-violet light.

Another object of the invention is to provide an anti-setting apparatus and method that are simple and easy to use.

Still another object of the invention is to provide an anti-setting apparatus that is plain of construction and easy and inexpensive of manufacture and installation.

Yet another object of the invention is to provide an anti-setting apparatus which can be readily be moved into and out of operative position in an ink fountain to accommodate readily ink changes and cleaning operations.

The objects of the invention are achieved by the discovery that subjecting stiff inks to vibration will keep them from setting. To this end, a metal bar is placed in a printing press ink fountain and vibrated. The metal bar is vibrated by connecting it to an oscillator. Activation of the oscillator sends a train of vibrations down the connection to the metal rod in the fountain. Vibration of the metal rod keeps the fountain ink from setting.

BRIEF DESCRIPTION OF THE DRAWINGS

These and other objects, and features and advantages, of the invention will become apparent from the following description, when taken with the accompanying drawings wherein.

DETAILED DESCRIPTION OF EMBODIMENT

Figure 2:
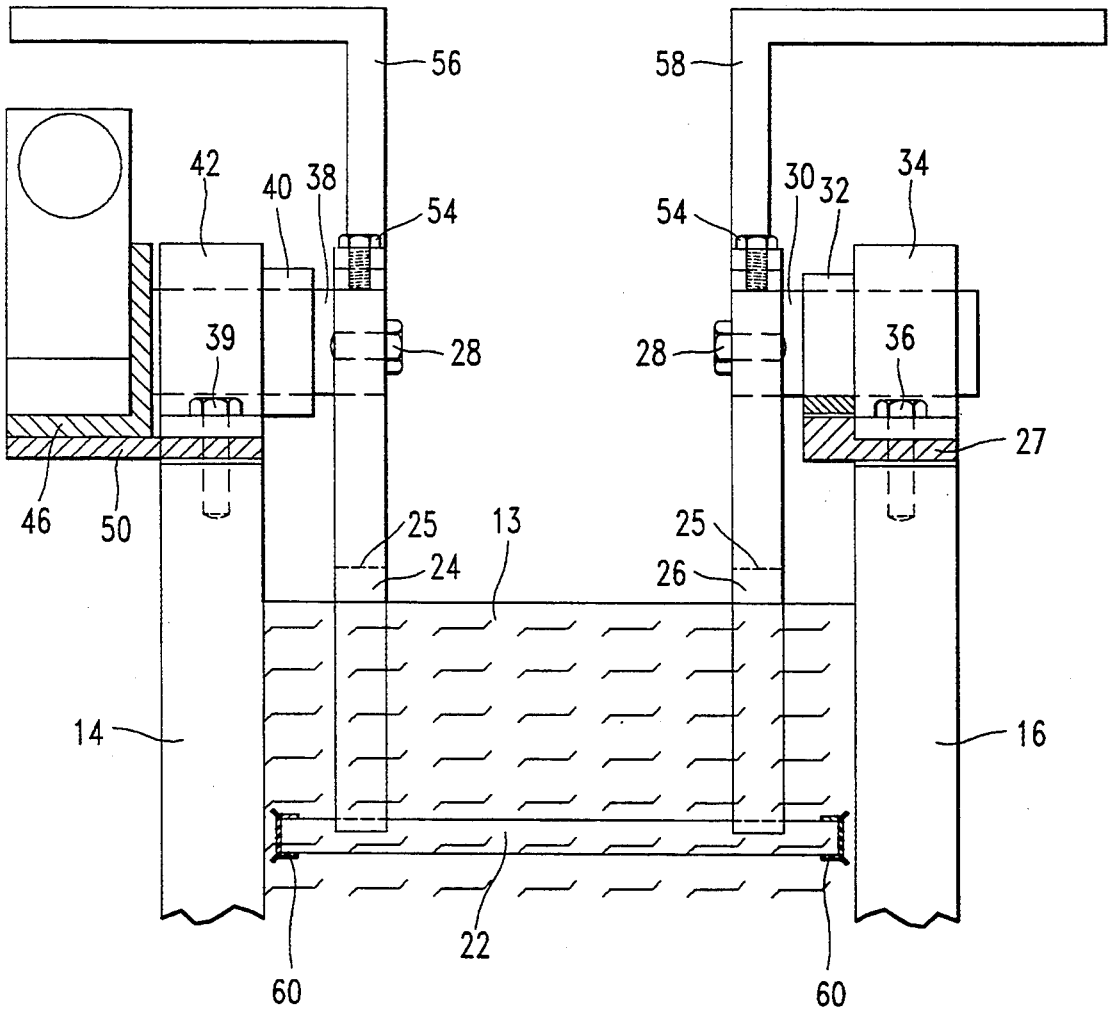
FIG. 2 is a diagrammatic front view of the embodiment of FIG. 1.
Figure 3:
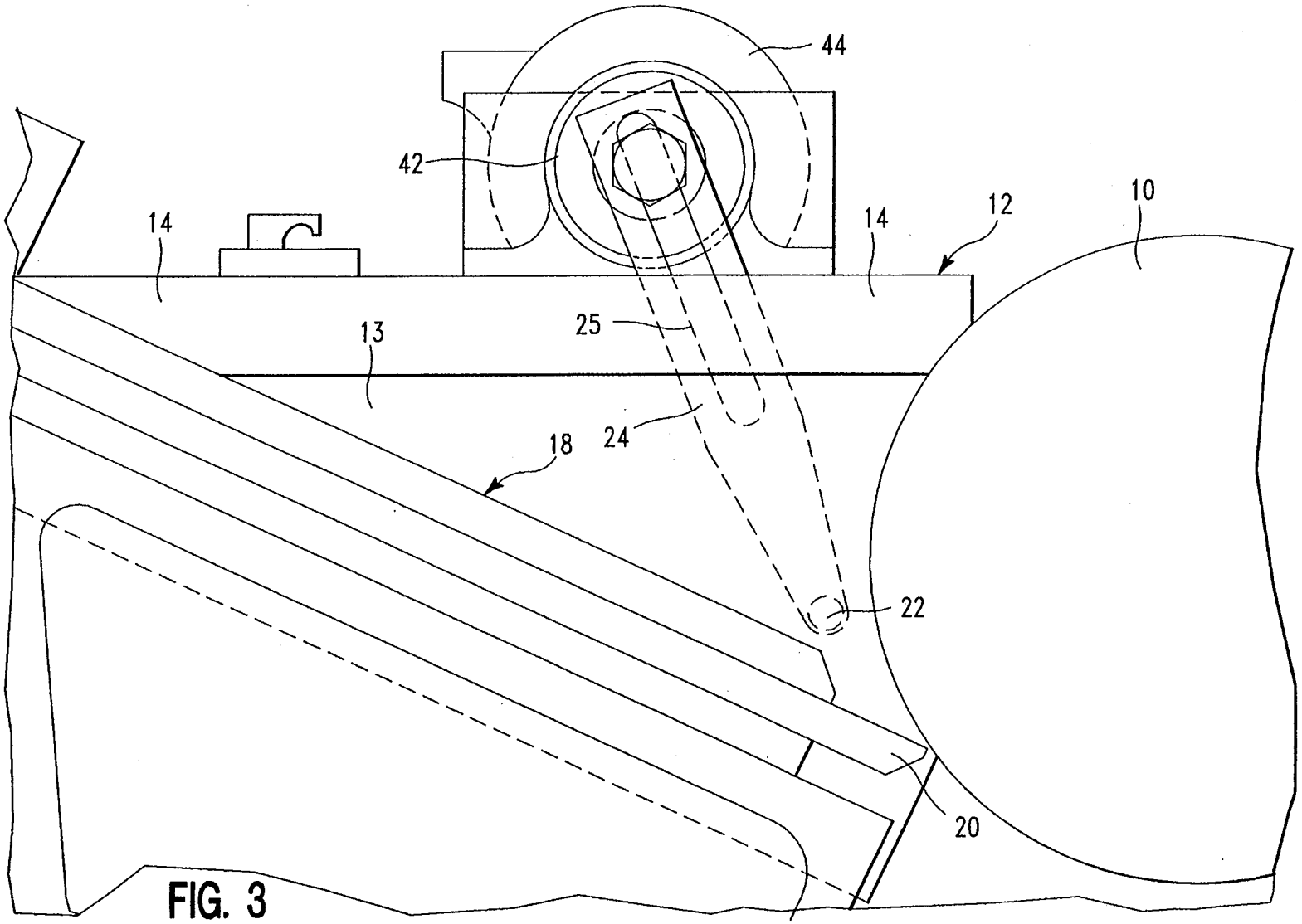
FIG. 3 is a side view of the embodiment of FIG. 1 and showing associated printing press apparatus.

Referring now to the drawings, there is shown therein portions of a high speed printing press. These portions include an ink roller 10 behind an ink fountain generally indicated by the number 12 and extending across the width of the roller 10. The ink fountain 12 holding ink 13, includes a left hand side wall or cheek 14 and a right hand side wall or cheek 16 (FIG. 2). An inking system in the fountain 12 comprising a knife blade assembly generally indicated by the number 18 (FIG. 3), includes a blade 20 whose free end is juxtaposed near the ink roller 10 to fix the amount of ink picked up by the roller as it rotates counterclockwise (as seen in FIG. 3) through the fountain and in contact with the ink therein. A free flowing ink able to wet uniformly the surface of the ink roller must obtain for effective high-quality printing operations.

As observed earlier, modern commercial printing operations employ inks such as those dried by ultraviolet light. Unfortunately, such inks are very stiff. More unfortunately, such inks tend to set very quickly, especially in the presence of ambient light such as that put out by florescent lights which are employed because of their lower energy and maintenance costs.

It has been discovered that vibrating an element in the stiff fountain ink will keep the ink from setting. To this end, a metal rod such as cold-rolled steel or tubing 22 is placed in the fountain ink at the throat formed by the knife blade assembly 18 and the roller 10. Vibration of the rod 22 maintains the ink in the fountain at the required viscosity for adequately wetting the surface of the ink roller 10 as the surface moves through the fountain ink.

Figure 1:
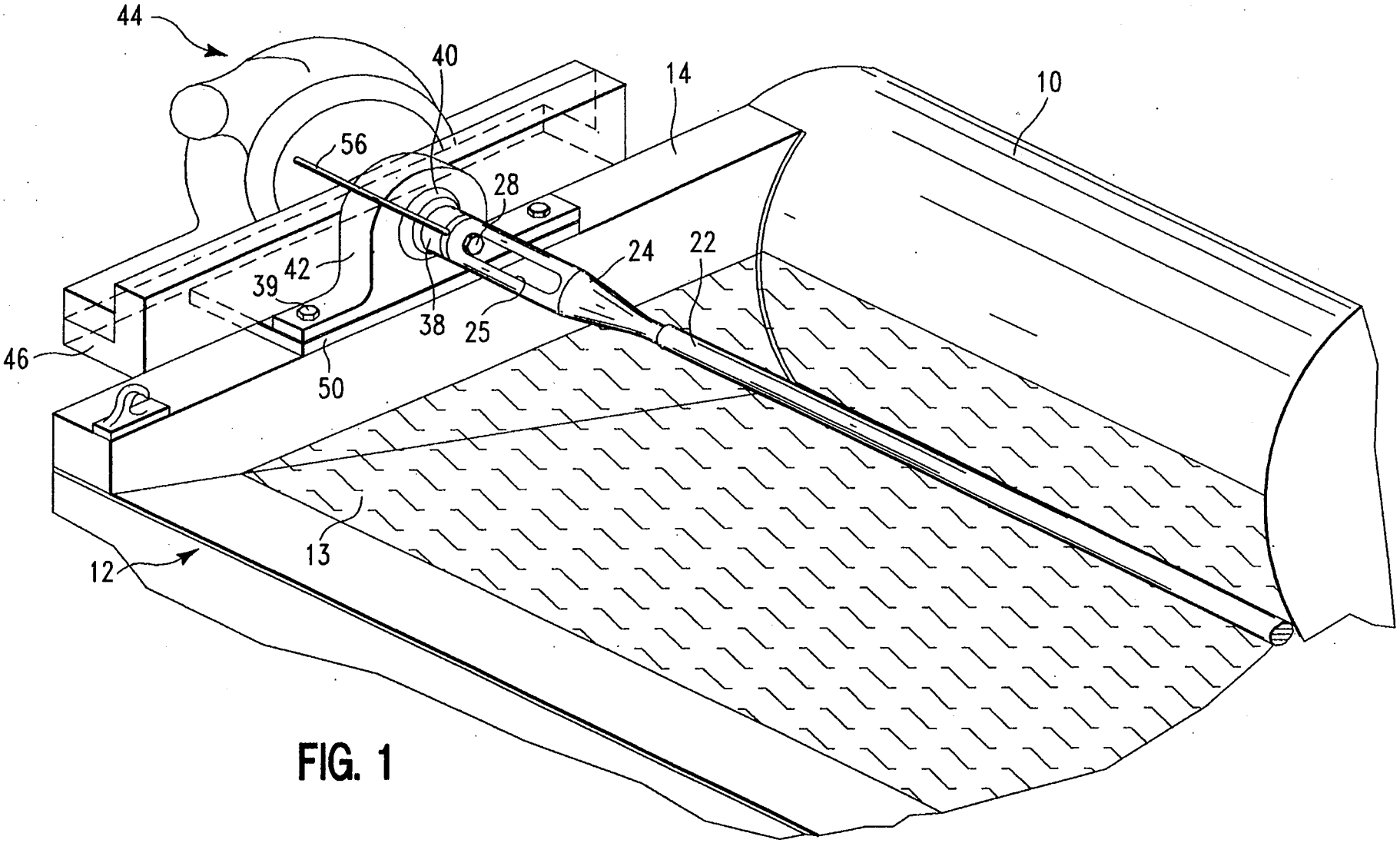
FIG. 1 is a view in perspective of an embodiment of the invention.

Vibrations are imparted to the rod 22 through the left side arm of a pair of side arms 24 and 26, respectively. The rod is secured to the side arms as by welding (see FIG. 2). The upper ends of the side arms are slotted as at 25 (FIGS. 1 and 3) to facilitate mounting the arms so that the rod 22 is at a preferred depth in the ink fountain. The preferred depth may vary, depending on the characteristics of the ink being used on a given run of the printing press.

Mounting of the arms 24 and 26 are effected by passing shoulder or lock bolts 28 outwardly through the slots 25. The bolt 28 for the right hand arm 26 is threadedly received in a trunnion 30 seated in the elastomeric (rubber) portion 32 of an isolator whose outer metal confining ring 34 is secured to the upper edge of the right hand fountain sidewall or cheek 26 through a spacer plate 27 by shoulder bolts 36. Thus while the right hand arm 26 can swing by virtue of being mounted on the trunnion 30, the vibrations received by it from the vibrating rod 22 will not be passed on to the ink fountain side wall 26 through the trunnion 30 because of the elastomeric portion 30 of the isolator.

The bolt 28 for the left hand arm 24 mounts the arm to a trunnion 38 seated in the elastomeric (rubber) portion 40 of an isolator whose outer metal confining ring 42 is secured to the upper edge of the left hand fountain side wall or cheek 24 by shoulder bolts 38. Thus while the left hand arm 24 can swing by virtue of being mounted on the trunnion 40, any vibrations received by it will not be passed on to the ink fountain side wall 26 but rather on to the side arm 24 and from the arm on to the rod 22.

Vibrations received by the trunnion 40 and passed on to the rod 22 through the side arm 24 may be from an oscillator generally indicated by the number 44 such as the commercially available air turbine oscillator VIBCO VS-190. Such an oscillator includes a mounting plate 46 shown as "L"-shaped in cross-section in FIG. 2. The vertical leg of the mounting plate is welded to the outer end of the trunnion 40. When the oscillator is actuated, as by opening a valve suitably connected to the oscillator and a source of air under pressure (all not shown), the mounting plate 46 is vibrated. The mounting plate vibrations are passed on to the trunnion 40 through their welded connection. The trunnion passes on the vibrations to the left hand side arm 24 through the shoulder bolt 28 connection between them. The left hand side arm passes on the vibrations to the rod 22 through the welded connection between them. The rod 22 vibrates the stiff ink in the ink fountain to keep it from setting.

The frequency of the vibrations delivered by the oscillator varies with the air pressure to which it is exposed. At 60 pounds per square inch (PSI), it delivers 4200 vibrations per minute (VPM); at 80 PSI, 7200 VPM. It is visualized that the oscillator will frequently be operated somewhere in the range of 1200 to 7200 VPM, dependent on the particular ink, temperature, lighting conditions, etc..

A spacer plate 50 may be secured to the upper edge of the left hand side wall 14 of the ink fountain 12 below the ring 42, by the bolts 38. The spacer plate 50, while not connected to the oscillator mounting plate 46, interacts with a flat side of it to keep it from rotating. This enables the accurate positioning of the side arms 24 and 26 and the rod 22 in the ink fountain, the shoulder nut 28 interconnecting the side arm 24 and trunnion 38 being loosened to enable movement to the desired angle. Of course, the shoulder nuts 28 for both the left and right side arms 24 and 26 respectively are loosened when it is desired to adjust the depth of the rod 22 in the fountain ink, the arm slots 25 accommodating endwise displacement. Locknuts or set screws 54 may be threadedly received in the upper ends of the side arms to help fix the endwise position of the arms with respect to the trunnions 30 and 38. Levers 56 and 58 may be welded to the arms 24 and 26 respectively for aid in moving the rod 22 to a desired position within the ink fountain 12 and for removing the rod 22 from the ink fountain for cleaning purposes. The levers 56 and 58 may be formed integrally as is suggested in FIG. 1. Rubber tips 60 may be formed on the ends of the rod 22 to preclude any accidental contact of the rod 22 metal with the sidewalls of the ink fountain 12.

in use, the anti-setting rod 22 would be suitably positioned in the ink fountain 12 for the particular ink being used. To this end, the shoulder bolts 28 would be loosed to accommodate sliding and angular movement of the side arms 24 and 26 to which the rod 22 is welded. Levers 56 and 58 could be grasped to effect the desired positioning.

Once the rod 22 is properly positioned in the ink of the ink fountain, the oscillator 44 is actuated as by opening a valve. The oscillations of the oscillator 44 result in vibrations being imparted to the mounting plate 46 which being welded to the trunnion 38 passes the vibrations on to it. Being mounted in the elastomeric portion (rubber) of the isolator, the trunnion only passes the vibrations on to the side arm 28 securely fixed to it by the should bolt 28. The side arm 24, being welded to the rod 22, passes the vibrations on to it. The rod 22 imparts vibrations to the ink in the fountain 12 to keep the ink from setting.

Some vibrations will travel up the arm 26 and onto the trunnion 30 which accommodates swinging movement of the arm 26 even when the shoulder bolt is on tight; but the vibrations will not be passed on the right hand wall 16 of the ink fountain 12 because of the elastomeric portion 32 of the isolator. A shoulder portion formed on the internal side of the spacer plate 27 may cooperate with a flat side of the elastomeric portion 32 to keep it from turning and wearing loose.

It will be apparent that applicant has provided a novel apparatus and method for preventing the setting of printing inks. Further, that the apparatus and method provided are simple and easy to use, being readily adjustable and plain of construction and easy and inexpensive of manufacture and installation, almost the whole being standard, commercially available parts that are easily assembled and mounted in a printing press. Moreover, the design enables easy movement of the vibration rod in and out of operative position to accommodate adjustments and cleaning operations.

The embodiment has been described with respect to high-speed web-fed printing presses; however, the invention is also useful in other printing mechanisms including those feeding single sheets.

It will thus be appreciated that while applicant has shown and described a particular embodiment of the principles of the invention, various other embodiments can be made of the principles of the invention, and it is intended that the patent be limited only by the spirit or scope of the appended claims.

What is claimed is:

1. An anti-setting device for stiff printing inks, comprising an element for vibrating the ink, wherein the element is for placement in the ink, wherein the element is a rod, wherein the rod is mounted on an arm, wherein the rod is also mounted on a second arm.

2. A device according to claim 1, wherein the two arms are mounted on trunnions.

3. A device according to claim 2, wherein the trunnions are seated in elastomeric mounts.

4. A device according to claim 3, wherein an oscillator is connected to one of the trunnions to impart vibrations thereto which are passed on through the associated arm to the rod.

5. In a printing press, a stiff ink supply, and an anti-setting device for stiff printing inks and which comprises an element for vibrating the ink, wherein the ink supply is contained in a fountain cooperating with an ink roller, wherein the element is a rod generally extending in the fountain over the width of the roller.

6. A printing press according to claim 5, wherein the rod is mounted on two arms.

7. A printing press according to claim 6, wherein the arms are mounted on trunnions, and the trunnions are mounted in vibration isolators fixed to the side walls of the ink fountain.

8. A printing press according to claim 7, wherein an oscillator is fixed to one of the trunnions to impart vibrations thereto for transmission down the associated arm to the rod and thence to the ink.

* * * * *